United States Patent [19]

Wallace et al.

[11] Patent Number: 4,641,949

[45] Date of Patent: Feb. 10, 1987

[54] CONDUCTIVE BRUSH PAPER POSITION SENSOR

[75] Inventors: Stanley J. Wallace, Victor; Josef E. Jedlicka; Wilbur M. Peck, Jr., both of Rochester, all of N.Y.

[73] Assignee: Xerox Corporation, Stamford, Conn.

[21] Appl. No.: 769,515

[22] Filed: Aug. 26, 1985

[51] Int. Cl.[4] ..... G03G 15/00

[52] U.S. Cl. ..... 355/3 SH; 355/3 R; 355/14 SH; 271/258

[58] Field of Search ..... 355/3 SH, 3 R, 3 CH, 355/14 SH, 14 R; 271/258, 259, 261, 264

[56] References Cited

U.S. PATENT DOCUMENTS

| | | | |
|---|---|---|---|
| 2,506,454 | 5/1950 | Holmwood | 175/183 |
| 2,818,252 | 12/1957 | Nilsson | 271/57 |
| 2,947,917 | 8/1960 | O'Brien | 317/149 |
| 3,689,143 | 10/1972 | Case et al. | 355/3 |
| 3,757,164 | 10/1973 | Binkowski | 317/2 R |
| 4,336,565 | 6/1982 | Murray et al. | 355/3 CH X |
| 4,363,550 | 12/1982 | Toshimitsu et al. | 355/3 SH X |
| 4,391,510 | 7/1983 | Cherian | 355/3 SH |
| 4,468,113 | 8/1984 | Motohashi et al. | 355/3 SH X |
| 4,523,754 | 6/1985 | Hisajima et al. | 355/3 SH X |

OTHER PUBLICATIONS

Xerox Disclosure Journal vol. 9, No. 6, Nov./Dec. 1984.

*Primary Examiner*—A. C. Prescott

*Attorney, Agent, or Firm*—R. F. Chapuran

[57] ABSTRACT

The present invention is concerned with a switching element comprised of oppositely disposed conductive fiber brushes and/or brush-like elements for detecting the presence or absence of paper at various locations in a xerographic copy machine. The oppositely disposed brushes are made from poly-acrylo-nitrile, a carbon based polymer material, which can be fabricated with relatively low values of resistance. Typical fiber bundles may consist of 6000 individual fibers each of 6–10 microns in diameter. In operation each individual conductive fiber acts as a separate electrical path through which the external circuit is completed. Passage of paper through the "nip" of the fiber to fiber electrical contact opens the circuit which is easily detected through associated circuitry which indicates the presence of paper. Likewise, arrays incorporating multiple such sensor switches may be fabricated for the purpose of indicating the size of the document interrupting specific low resistance fiber-fiber switches.

4 Claims, 6 Drawing Figures

CONDUCTIVE BRUSH PAPER POSITION SENSOR

This invention relates to a paper position sensor and, in particular, to a switch element and paper sensor using discrete low resistance conductive fiber bundles.

The prior art is replete with sensors and systems for sensing the size of a document of copy sheet. For example, U.S. Pat. No. 3,689,143 assigned to the assignee of the present application, generally shows the determination of the size of a document by discrete electro-optic sensors positioned across the sheet or document path. U.S. Pat. Nos. 2,818,252 and 2,947,917 show the use of electrical contacts to detect the presence of a sheet along a feed path. It is also known to use resilient conductive filaments of minute diameter attached to a support and electrically connected to a ground potential to reduce the potential of static electrical charges present on a sheet or web, as described in U.S. Pat. No. 3,757,164.

It is also described in Xerox Disclosure Journal, Vol. 9, No. 6, November/December 1984, to use a continuous array of conductive fibers across the path of a sheet for determining sheet size by the overall resistance of the interrupted fibers. However, it has been found undesirable for the fiber brush to extend across and rub against the entire document as it passes underneath since this induces additional friction and possible contamination.

It is also known from U.S. Pat. No. 2,506,454 to use a brush whose bristles are conductive to detect a flaw such as a hole in a web. Also, IBM Technical Disclosure Bulletin, Vol. 19, No. 6, November 1976 shows the manual actuation of one of three switches to indicate the size of paper in a bin and also a paper size sensing station to provide output signals in accordance with the sizes of papers passing through the station. It is also known in the prior art to use a conductive brush that normally contacts a plurality of separate insulative electrodes, each of the electrodes separately connected to a control circuit.

In typical prior art switch systems, one side of the switch is often composed of a harder material than the other and the combination of the two materials is chosen (metallic contacts) so that as low a contact resistance is maintained for the life of the switch. Many other factors influence the operation of prior art switches including the voltage and current combinations, formation of intermetalic films with time and the generation of an arc to maintain a cleaning action. It would be desirable, however, to provide a switch system that is simple and economical and overcomes many of the forementioned difficulties.

In a recirculating document handler in a Xerographic machine it is often desirable to know the size of the document or sheet in order to control the general timing of the Xerographic process and, in particular, in order to activate fade out lamps or shutters or other specific processes. Sometimes the size of the document or sheet is such that movable side guides are impractical. In other instances discrete optical sensors do not serve the purpose since they must span the entire length or width of the document and would be prohibitably expensive. It would be desirable therefore to provide a simple document or sheet size detector or sensor that is economical and reliable.

Accordingly, it is an object of the present invention to provide a new and improved document or sheet size sensor. It is another object of the present invention to provide a document or sheet size sensor that is simple, reliable and economical. It is still a further object of the present invention to provide a document or sheet size sensor that is comprised of an array of oppositely disposed contacting fiber brush pairs, such that electric current is conducted through the fiber brush pair when in contact and the circuit is open then a document interrupts the fiber brush contact. Further advantages of the present invention will become apparent as the following description proceeds and the features characterizing the invention will be pointed out with particularity in the claims annexed to and forming a part of this specification.

Briefly, the present invention is concerned with an array of oppositely disposed conductive fiber brushes for detecting the size of a document or copy sheet. The oppositely disposed brushes are made from a conductive polymer material, each fiber bundle containing approximately 6,000 individual fibers each 6 to 10 microns in diameter. In operation, the oppositely disposed fibers maintain electrical contact and the passage of paper through the nip of the brushes opens the contact to indicate the presence of paper. An array of discrete fiber brush pairs provides signals indicating the size of the document interrupting selected fiber brush pairs.

For a better understanding of the present invention, reference may be had to the accompanying drawing, wherein the same reference numerals have been applied to like parts and wherein.

Figure 4A:
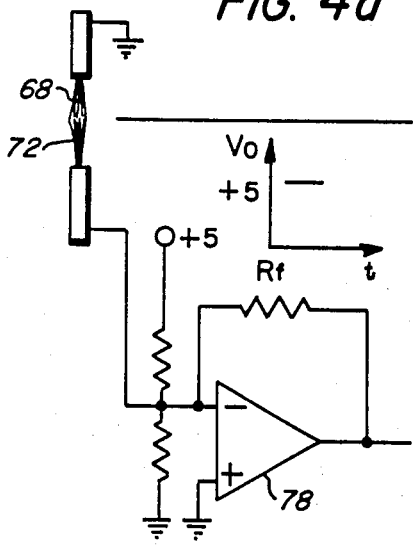
Figure 4B:
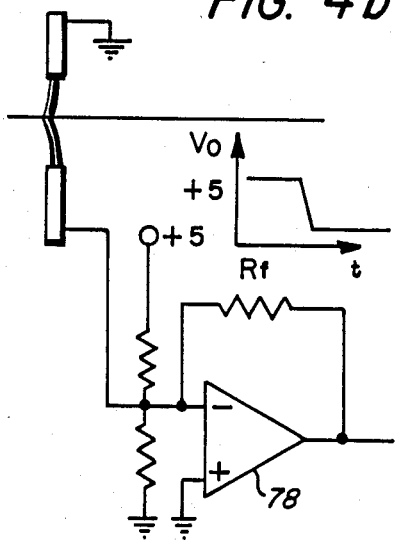
Figure 5:
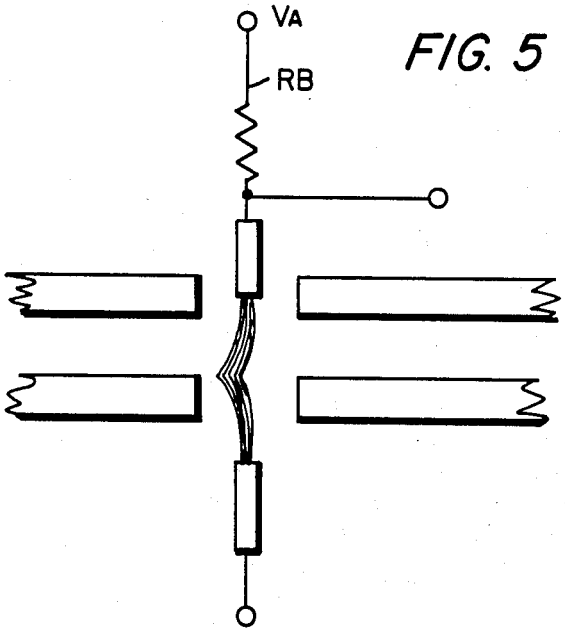

FIGS. 4*a* and 4*b* illustrate a conductive fiber sensor with no paper present and with paper present; and FIG. 5 illustrates an equivalent DC circuit for the conductive fiber switch of the present invention.

Figure 1:
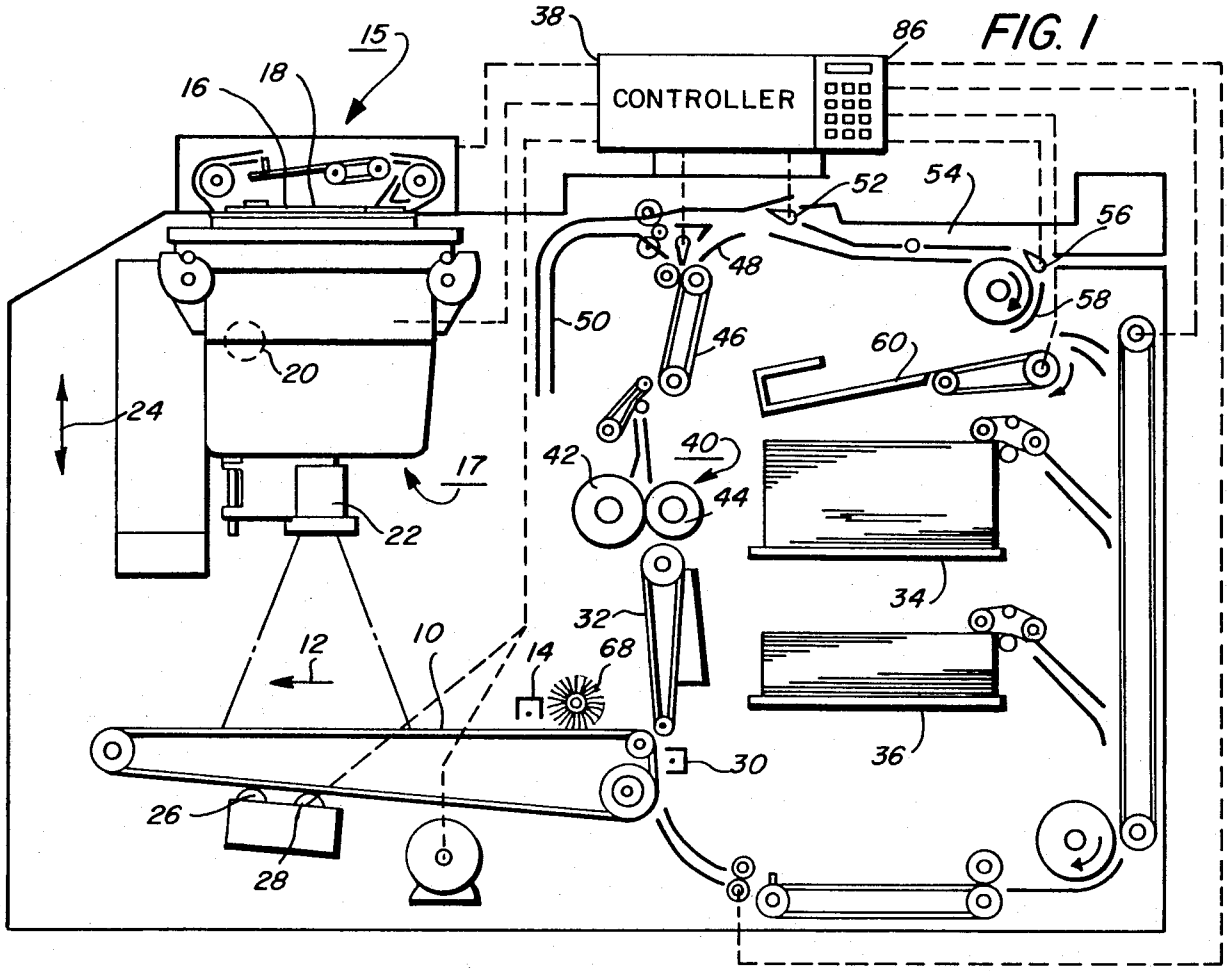
FIG. 1 is a representation of a reproducing apparatus incorporating the present invention.

With reference to FIG. 1, there is shown an electrophotographic printing or reproduction machine employing a belt 10 having a photoconductive surface. Belt 10 moves in the direction of arrow 12 to advance successive portions of the photoconductive surface through various processing stations, starting with a charging station including a corona generating device 14. The corona generating device charges the photoconductive surface to a relatively high substantially uniform potential.

The charge portion of the photoconductive surface is then advanced through an imaging station. At the imaging station, a document handling unit 15 positions an original document 16 facedown over exposure system 17. The exposure system 17 includes lamp 20 illuminating the document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge. This records an electrostatic latent image on the photoconductive surface corresponding to the informational areas contained within the original document.

Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10.

Document handling unit 15 sequentially feeds documents from a holding tray, in seriatim, to platen 18. The document handling unit recirculates documents back to the stack supported on the tray. Thereafter, belt 10 advances the electrostatic latent image recorded on the photoconductive surface to a development station.

At the development station of pair of magnetic brush developer rollers 26 and 28 advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the toner powder image from the photoconductive surface of belt 10 to the sheet.

The copy sheets are fed from a selected one of trays 34 and 36 to the transfer station. After transfer, conveyor 32 advances the sheet to a fusing station. The fusing station includes a fuser assembly for permanently affixing the transferred powder image to the copy sheet. Preferably, fuser assembly 40 includes a heated fuser roller 42 and a backup roller 44 with the powder image contacting fuser roller 42.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second gate 52. Decision gate 52 deflects the sheet directly into an output tray 54 or deflects the sheet into a transport path which carries them on without inversion to a third gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60. Duplex tray 60 provides intermediate or buffer storage for those sheets which have been printed on one side for printing on the opposite side.

Figure 2:
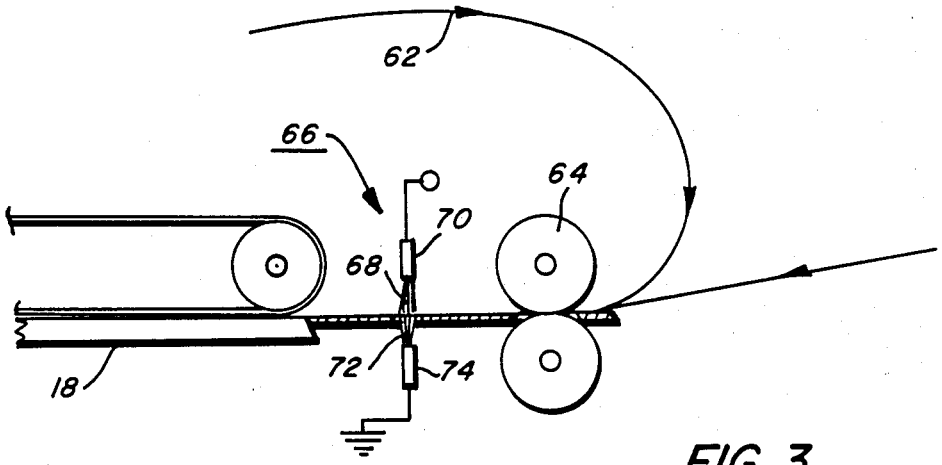
FIG. 2 illustrates in detail the recirculating document handler of FIG. 1 incorporating the present invention.

With reference to FIG. 2, there is shown the path 62 of movement of a document 16 driven by pinch rolls 64 through document size sensor array 66 onto platen 18. The document size sensor array 66 generally includes an array of oppositely disposed conductive fiber brush pairs. One such pair is illustrated as fiber brush 68 carried in upper support 70 in electrical contact with fiber brush 72 carried in lower support 74. The array is mounted transversely to the sheet path and each discrete sensor pair is positioned to contact and be deflected by passage of a document between the pair. When no document is present, the brush fibers form a closed electrical circuit. It should be noted that single position sensors can also be used.

Figure 3:
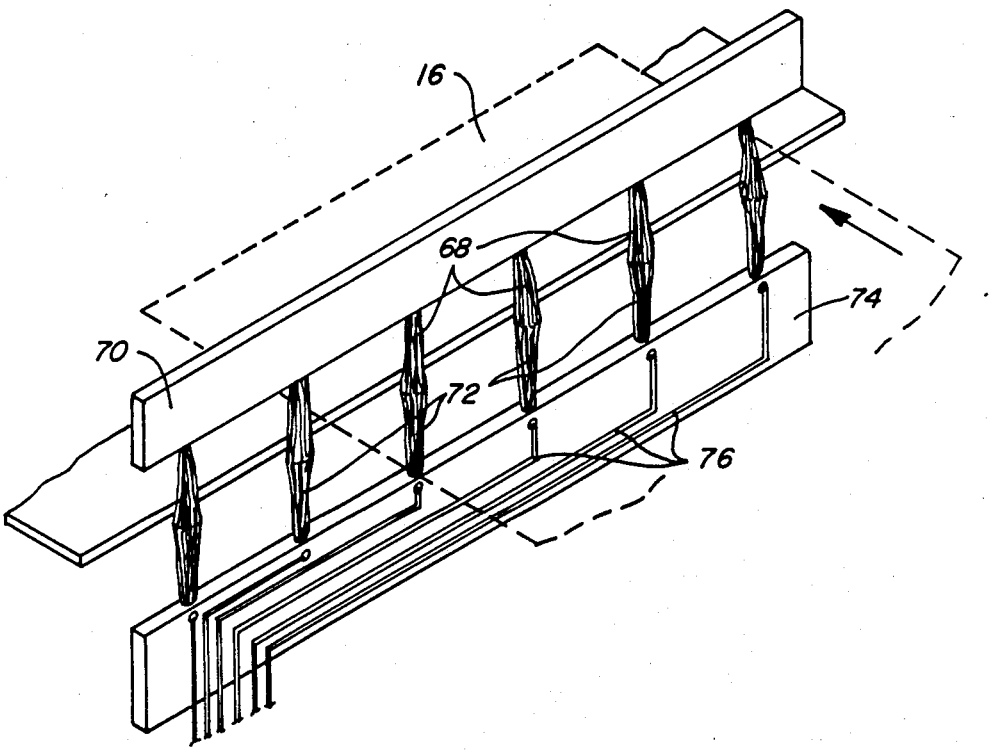
FIG. 3 is a illustration of a switch array incorporating the present invention.

With reference to FIG. 3, there is shown the sensor array 66 including the upper support 70 supporting six downwardly disposed fiber brushes 68 and a lower support 74 securing six upwardly extending fiber brushes 72 and suitable electrical conductors 76. A typical paper or document 16 is illustrated as moving toward the nip of the brush to brush contacts. The brush to brush contacts form a normally closed electrical circuit in the paper path. The passage of the document 16 through the nip of a particular brush contact opens the contact between the engaged brushes to open the circuit.

FIGS. 4*a* and 4*b* illustrate typical electrical circuitry to indicate the presence or the lack of presence of paper between a particular brush to brush nip. In FIG. 4*a* with no paper present there is contact between brushes 68 and 72 and there is a plus 5 voltage output from the amplifier 78. In FIG. 3*b* with paper interrupting the contact there is a step down in the voltage output from the amplifier 78 as illustrated. It should be noted that many variations of circuitry are available to provide suitable signals to indicate the presence or the lack of a presence of paper between nips of the fiber brushes. It should also be noted that it is routine to provide circuitry to connect the discrete brush contacts in an array such that it is possible to sense which particular switch contacts are closed and which particular switch contacts are open with the presence of a document or copy sheet to indicate the size of the copy sheet or document.

In a preferred embodiment, any suitable conductive fibers can be used such as a poly-acrylo-nitrile (PAN) that are relatively conductive (approximately 10 to 100 ohms resistance per bundle). The applications operate at relatively low voltages in the order of 5 to 24 volts DC. A typical fiber bundle contains approximately 6000 individuals fibers each 6 to 10 microns in diameter.

With respect to FIG. 5, there is shown a discrete switch suitable for use in an array of switches. The normally closed switch position is illustrated. A potential difference VA is applied across a combination of a series biasing resistor $R_b$ and the fiber/fiber interface to ground, defining a rest state current. Other factors such as the types of electrically conductive adhesives and the process variations in the conductive fibers determine actual rest bias current and these values may be adjusted to achieve an acceptable signal for lower voltage applications. With the fibers in contact, the current through the system would then be the voltage VA divided by the resistance rb and the combined resistance of the two fiber brushes and the conductors through the fiber brush supports.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A machine for reproducing an original document onto a sheet including:

a sheet supporting tray, sheet feed means to forward a sheet from the tray through the reproducing machine for having a copy of the original created thereon, optical means for projecting, along an optical path, a light pattern of a document to be reproduced, support means for moving the document past one end of said optical path, sensing means adjacent said document support means to sense the size of the document to be reproduced, said sensing means including a first array of spaced discrete conductive fiber brushes and a second array of spaced discrete conductive fiber brushes oppositely disposed from the first array forming sensor pairs, each of the discrete conductive fiber brushes comprising polyacrylonitrile fibers in the range of 10 to 100 ohms resistance per bundle, the oppositely disposed conductive fiber sensor pairs normally being in electrical contact, the electrical contact of each pair being interrupted by the presence of a portion of a document between the sensor pair, and circuit means for providing a signal indicative of the presence or lack of presence of a portion of a document between a selected sensor pair.

2. The machine of claim 1, wherein each of the discrete conductive fiber brushes is a conductive polymer material, each brush including approximately 6,000 individual fibers 6–10 microns in diameter.

3. In a reproduction machine having a document handler for conveying documents to an imaging station, a device for determining the size of a document comprising at least two oppositely disposed conductive fiber brushes, said oppositely disposed conductive fiber brushes being a part of an array of discrete oppositely disposed conductive fiber brushes, each of the fiber brushes comprising conductive carbon based polymer fibers in the range of 10 to 100 ohms resistance per bundle, said reproduction machine also including a plurality of operating components to produce images of documents on support material, said brushes being mounted in the vicinity of the path through which the document shall be advanced and arranged to cooperate in such a manner that the brushes are normally in contact when there is no portion of a document present and the electrical contact is broken with the presence of a portion of the document between the oppositely disposed fiber brushes whereby the size of the documents can be determined to timely control said operating components.

4. The device of claim 3, wherein each of the fiber brushes includes approximately 6,000 individual polyacrylonitrile fibers 6–10 microns in diameter.

* * * * *